US012426653B1

(12) United States Patent
Taboada

(10) Patent No.: US 12,426,653 B1
(45) Date of Patent: Sep. 30, 2025

(54) PRE-CONFIGURED SCARF WITH BUILT-IN CLOSURE

(71) Applicant: Lynette Taboada, Westhampton, NY (US)

(72) Inventor: Lynette Taboada, Westhampton, NY (US)

( * ) Notice: Subject to any disclaimer, the term of this patent is extended or adjusted under 35 U.S.C. 154(b) by 0 days.

(21) Appl. No.: 18/883,550

(22) Filed: Sep. 12, 2024

Related U.S. Application Data

(63) Continuation-in-part of application No. 17/574,350, filed on Jan. 12, 2022, now Pat. No. 12,089,672.

(60) Provisional application No. 63/137,339, filed on Jan. 14, 2021.

(51) Int. Cl.
*A41D 23/00* (2006.01)

(52) U.S. Cl.
CPC ..... *A41D 23/00* (2013.01)

(58) Field of Classification Search
CPC ..... A41D 23/00; A41D 25/00; A42B 1/04; A42B 1/041; A42B 1/045; A42B 1/006; A41B 13/10
See application file for complete search history.

(56) References Cited

U.S. PATENT DOCUMENTS 586,132 A * 7/1897 Lane ..... A41D 3/08 2/88
1,042,351 A * 10/1912 Johnstone ..... A42B 1/006 2/207
2,524,775 A * 10/1950 De Grazia ..... A42B 1/045 2/88
5,233,704 A * 8/1993 Booher ..... A41D 23/00 2/207
5,490,528 A * 2/1996 Day ..... A45D 20/20 2/202
2006/0253958 A1* 11/2006 Debrick ..... A41D 27/18 2/206
2011/0126340 A1* 6/2011 Wu ..... A42B 1/206 2/200.1
2012/0317702 A1* 12/2012 Daly ..... A41D 23/00 2/265
2014/0157488 A1* 6/2014 McGregor ..... A41D 23/00 2/207
2017/0208881 A1* 7/2017 Leathers ..... A41D 23/00

* cited by examiner

*Primary Examiner* — Khoa D Huynh
*Assistant Examiner* — Giao Q T Hoang
(74) *Attorney, Agent, or Firm* — BKDowd Law, P.C.; Betsy Kingsbury Dowd, Esq

(57) ABSTRACT

A scarf includes draw-strings confined in channel(s) between end sections, extending across a neck portion connecting the end sections, and aligned along a central longitudinal axis between an upper and lower edge of the scarf in an open position. The draw-strings are aligned side-by-side via the channel(s), extend downward along a front of a user as worn, and are fixed at opposite ends of the channel(s) to allow them to be pulled in opposite directions down along the front of a user. Concealed attachment elements positioned at the ends of the channel(s) and along the central longitudinal axis form a closure when connected in the front of the scarf as worn. Pulling on the draw-strings with the scarf in the closed position creates a gathered aesthetic along the front of the user and adjusts the positioning of the scarf around and under the wearer's neck.

11 Claims, 13 Drawing Sheets

PRE-CONFIGURED SCARF WITH BUILT-IN CLOSURE

CROSS-REFERENCE TO RELATED APPLICATIONS

This application is a continuation-in part application of Applicant's co-pending U.S. application Ser. No. 17/574,350, filed Jan. 12, 2022, entitled "PRE-CONFIGURED SCARF WITH BUILT-IN CLOSURE," which claims the benefit of and priority to U.S. Provisional Application Ser. No. 63/137,339 entitled "PRE-CONFIGURED SCARF WITH BUILT-IN CLOSURE," filed Jan. 14, 2021, the entirety of each of which is hereby incorporated herein by reference thereto.

FIELD OF DISCLOSURE

The present disclosure relates generally to clothing accessories, in particular, to scarfs.

BACKGROUND

Scarves are well-known accessories that are generally long rectangular pieces of fabric that are arranged and tied about the neck of a person to form a desired shape and aesthetic design. While scarves are also used to keep one's neck warm and protected from the elements, it is still desirable to tie such scarves in an aesthetically pleasing manner. A certain amount of skill and practice is necessary to achieve the desired look by folding, gathering, and/or tying. Some attempts have been made to simplify the tying of scarves by a user and still achieve a certain look. For example, US Pub. No. 2007/0017004 by Sims-Perry discloses a pre-tied adjustable buttoned scarf tied in the form of an ascot or nautical square which requires no tying but is meant to create the illusion of a self-tied scarf or ascot. The scarf includes a neck band adjustable to neck size using buttonholes and a pre-tied attachment on the form of an ascot or nautical square sewn into the adjustable neck band. Even though the Sims-Perry scarf does not require tying—or retying—the particular knot, which is pre-tied, it does require readjusting the neck size by buttoning at the back of the neck each time the scarf is attached.

While such attempts have been made to achieve a pre-tied scarf, they are limited to a limited type of knots, such as nautical squares and bowties, and do not allow a user to remove and reattach the pre-tied scarves quickly and easily, in a manner that achieves a consistent, reproducible look for a variety of pre-tied aesthetic scarf designs while creating the illusion of a self-tied scarf.

Accordingly, there is a need for a pre-configured aesthetic scarf, which is pre-tied and pre-adjusted for neck size, which requires no tying but creates the illusion of a self-tied scarf.

SUMMARY

Features of the disclosure will become apparent from the following detailed description considered in conjunction with the accompanying drawings. It is to be understood, however, that the drawings are designed as an illustration only and not as a definition of the limits of this disclosure.

The present disclosure is directed to a pre-tied aesthetic scarf, pre-adjusted for neck size, having a built-in closure to create the illusion of a self-tied scarf for a consistent, reproducible look.

In one aspect, the scarf of the present disclosure includes two end sections, each end section including a portion of a pre-tied scarf design with an attachment element concealed within, each of the attachment elements configured to connect together to form the pre-tied scarf design. The scarf also includes a neck portion positioned between and connected to the two end sections.

In additional aspects, the attachment elements may be magnets.

In other aspects, the attachment elements may be either loop and hook pads, e.g., of a VELCRO® material, or snaps, or button and buttonhole, sewn in a manner that conceals them from view upon attachment.

In aspects, the size-adjusting element may be a draw-string.

The present disclosure is also directed to a pre-tied scarf, which includes a neck portion, and a size-adjusting element configured to adjust a size of the neck portion; and two end sections including a first end section and a second end section, the neck portion positioned and connectedly extending between the two end sections. Each of the two end sections has an attachment element concealed within. Each of the two end sections further includes a portion of the pre-tied scarf. Each attachment element is configured to connect together to form a closure about a neck of a wearer, wherein the pre-tied scarf including the closure is configured to appear, as worn, as a self-tied scarf.

In embodiments, each of the attachment elements is a magnet, each of the magnets being of opposite polarity and configured and aligned to snap together to form the closure.

The size-adjusting element may be a draw-string in embodiments.

The pre-tied scarf may be configured to form, as worn, any one of a nautical square, a bowtie, a front-tied scarf, and a pre-gathered scarf, but is not limited to any of these.

In embodiments, the pre-tied scarf may further include a channel sewn into the pre-tied scarf. The channel extends across the neck portion from the first end section to the second end section and has a first open end and a second open end located in the first end section and the second end section, respectively. The size-adjusting element includes a fixed end portion fixed to the second end section and a free end portion freely extending therefrom. The size-adjusting element preferably extends into the second open end of the channel and exits the channel through the first open end, the free end portion exiting the channel being accessible to a user and configured to be pulled by a user to gather and shorten a portion of the pre-tied scarf over which the channel extends.

In embodiments, the free end portion may include a push-button lock. The push-button lock is unlocked in a depressed position and locked in a released position, and is slidable along the free end portion in the depressed position. Once the user has gathered the scarf as desired by adjusting the size-adjusting element, the push-button lock is released to lock it, in the released position, in order to maintain the size of the neck portion desired.

The pre-tied scarf also preferably includes an interior side that is not visible as worn, wherein the channel is sewn onto the interior side.

In embodiments, the channel is formed of a satin material.

The pre-tied scarf may also further include an inner side and an outer side opposite the inner side, wherein the inner side of the neck portion faces a neck of a user as worn, and the inner side of the first end section faces the inner side of the second end section as worn.

The pre-tied scarf may further include a slit opening in the first end section proximate the first open end of the channel, wherein the slit opening extends from the interior side of the pre-tied scarf to the inner side of the pre-tied scarf. The free end portion of the size-adjusting element that exits the channel through the first open end is laced through the slit opening to the inner side of the pre-tied scarf and configured for access by a user.

In embodiments, each of the attachment elements is a magnet, each of the attachment elements being of opposite polarity and configured and aligned to snap together to form the closure.

In further embodiments, a first one of the attachment elements may be positioned on the inner side of the first end section and a second one of the attachment elements is positioned on the outer side of the second end section and aligned to form the closure as worn.

The present disclosure is also directed to a pre-tied scarf, which includes a neck portion; a first draw-string and a second draw-string configured to adjust a size of the neck portion; and a first end section and a second end section, the neck portion positioned and connectedly extending between the first end section and the second end section. Each of the first end section and the second end section further include a portion of the pre-tied scarf, wherein each of the first end section and the second end section has an attachment element concealed within, which may be a magnetic attachment, configured to snap together to form a closure about a neck of a wearer. The pre-tied scarf including the closure is configured to appear, as worn, as a self-tied scarf.

In embodiments, the pre-tied scarf further includes a channel sewn into the pre-tied scarf, the channel extending across the neck portion from the first end section to the second end section and having a first open end and a second open end located in the first end section and the second end section, respectively. The first draw-string and the second draw-string are captured within the channel and configured to be pulled by a user to gather and shorten a portion of the pre-tied scarf over which the channel extends.

In embodiments, the first draw-string includes a fixed end portion fixed to the second end section and a free end portion freely extending therefrom. The first draw-string extends into the second open end of the channel and exits the channel through the first open end. The second draw-string includes a fixed end portion fixed to the first end section and a free end portion freely extending therefrom. The second draw-string extends into the first open end of the channel and exits the channel through the second open end, the free end portion of each of the first draw-string and the second draw-string being accessible to a user and configured to be pulled by a user in opposite directions to gather and shorten the portion of the pre-tied scarf over which the channel extends.

In embodiments, the free end portion of each of the first draw-string and the second draw-string includes a push-button lock. The push-button lock is unlocked in a depressed position and locked in a released position, the push-button lock being slidable along the free end portion in the depressed position, and locked to maintain the size of the neck portion in the released position.

The pre-tied scarf includes an interior side that is not visible as worn, wherein the channel may be sewn onto the interior side.

The pre-tied scarf may further include an inner side and an outer side opposite the inner side, wherein the inner side of the neck portion faces a neck of a user as worn, and the inner side of the first end section faces the inner side of the second end section as worn. The pre-tied scarf may further include a first slit opening in the first end section proximate the first open end of the channel and a second slit opening in the second end section proximate the second open end of the channel. Each of the first slit opening and the second slit opening extends from the interior side of the pre-tied scarf to the inner side of the pre-tied scarf. The free end portion of each of the first draw-string and the second draw-string that exits the channel through the first open end and the second open end, respectively, is laced through each of the first slit opening and the second slit opening, respectively, to the inner side of the pre-tied scarf and configured for access by a user as worn.

In embodiments, the attachment element concealed in the first end section is positioned on the inner side of the pre-tied scarf and the attachment element concealed in the second end section is positioned on the outer side and aligned to form the closure of the pre-tied scarf as worn.

The pre-tied scarf may be configured to form, as worn, one of a nautical square, a bowtie, a front-tied scarf, and a pre-gathered scarf.

The neck portion of the pre-tied scarf may include a gathered seam along a vertical centerline.

The present disclosure is also directed to a scarf, which includes a neck portion, centrally positioned and connectedly extending between a first end section and a second end section. The neck portion is configured for positioning in use behind a neck of a wearer, and each of the first end section and the second end section is configured to extend vertically downward below the neck portion and vertically opposite each other downward along a front of a wearer in use.

The scarf further includes a first edge, and a second edge running horizontally opposite to and below the first edge of the scarf in an open position ready for donning, and a central longitudinal axis defined centered horizontally between the first edge and the second edge of the scarf in the open position. The neck portion including the first edge, the second edge and the central longitudinal axis is configured for horizontally positioning around a wearer's neck in use, and the first edge, the second edge, and the central longitudinal axis of the first end section and the second end section of the scarf are configured to align vertically downward in use along a front of a wearer.

The scarf further includes a first channel and a second channel sewn into the scarf side-by-side along the central longitudinal axis, wherein a first draw-string and a second-drawstring are captured within the first channel and the second channel respectively. The first draw-string and the second draw-string are confined to the central longitudinal axis of the scarf via the first channel and the second channel to gather the scarf along the central longitudinal axis. Each of the first draw-string and the second draw-string extends between the first end section and the second end section and across the neck portion therebetween via the first channel and the second channel respectively, and downward along a front of a wearer in use. The first draw-string includes a fixed end portion and a free end portion between the first end section and the second end section, and the second draw-string includes a fixed end portion and a free end portion between the first end section and the second end section, each of the first draw-string and the second draw-string being configured to be pulled in opposite directions along and confined to the central longitudinal axis of the scarf via the first channel and the second channel respectively to form a gathered portion along a closure of the scarf below the neck portion and in a front of a wearer in use.

Each of the first end section and the second end section has an attachment element concealed within, which is aligned along the central longitudinal axis and configured to form the closure between the first end section and the second end section, and the gathered portion that extends downward along the closure in a front of a wearer in use.

The scarf with the gathered portion along the closure is configured to appear, as worn, as a self-tied, gathered scarf around a neck and a front of a wearer in use.

In embodiments, the scarf includes an inner side defined between the first edge and the second edge, and an outer side of the scarf opposite the inner side. The inner side of the neck portion faces a neck of a wearer as worn, and the inner side of the first end section faces, contacts, and is connected to, one of the inner side and the outer side of the second end section at the central longitudinal axis via the attachment elements in a closed position of the scarf. The inner side of the first end section and the one of the inner side and the outer side of the second end section are connected via the attachment element in each of the first end section and the second end section to form the closure along the central longitudinal axis.

In further embodiments, the first channel of the scarf has a first open end located in the first end section and an end opposite the first open end located in the second end section. The second channel has a second open end located in the second end section and an end opposite the second open end located in the first end section. The first draw-string and the second draw-string are configured to be pulled downward within the first channel and the second channel, respectively, in opposite directions by a wearer to gather and shorten the gathered portion of the scarf in use, wherein the gathered portion defined by the first channel and the second channel extends from the first end section across the neck portion and to the second end section and downward along the closure and along a front of a wearer in use. The fixed end portion of the first draw-string is fixed to the second end section at the end of the first channel, the first draw-string extending through the first channel and its free end exiting the first channel through the first open end, and the fixed end portion of the second draw-string is fixed to the first end section at the end of the second channel, the second draw-string extending through the second channel and its free end exiting the second channel through the second open end. The free end portion of each of the first draw-string and the second draw-string is accessible to a wearer and configured to be pulled by a wearer in opposite directions to gather and shorten the portion of the scarf over which the first channel and the second channel extend.

In embodiments, each of the attachment element in the first end section and the attachment element in the second end section is positioned outside the first open end and the second open end of the first channel and the second channel, respectively.

In additional embodiments, the free end portion of each of the first draw-string and the second draw-string includes a push-button lock, the push-button lock being unlocked in a depressed position and locked in a released position, the push-button lock being slidable along the free end portion in the depressed position, and locked to maintain the size of the neck portion in the released position.

Each of the first channel and the second channel may be sewn onto an interior side of the scarf that is not visible as worn.

In further embodiments, the scarf may include a first slit opening in the first end section positioned proximate the first open end of the first channel and a second slit opening in the second end section positioned proximate the second open end of the second channel. Each of the first slit opening and the second slit opening may extend from the interior side of the scarf to the inner side of the scarf, and the free end portion of each of the first draw-string and the second draw-string that exits each of the first open end and the second open end of the first channel and the second channel, respectively, may be laced through each of the first slit opening and the second slit opening, respectively, to the inner side of the scarf and configured for access by a wearer as worn.

In embodiments, the attachment element concealed in the first end section may be positioned on the inner side of the scarf and the attachment element concealed in the second end section may be positioned on the outer side and aligned to form the closure of the scarf as worn, the inner side of the first end section facing and contacting the outer side of the second end section via the attachment elements to form the gathered portion along a front of a wearer in use.

The neck portion of the scarf, in embodiments, may include a gathered seam along a vertical centerline defined vertically downward from the first edge to the second edge in the neck portion of the scarf in the open position.

Each of the attachment elements, in additional embodiments, is a magnet, each of the magnets being of opposite polarity and configured and aligned to snap together to form the closure.

The scarf, in embodiments, may have a rectangular or bowtie shape in the open position. The inner side may be tacked to the outer side at each corner of the scarf to maintain its shape in the open position.

In addition to the above aspects of the present disclosure, additional aspects, objects, features and advantages will be apparent from the embodiments presented in the following description and in connection with the accompanying drawings.

BRIEF DESCRIPTION OF THE DRAWINGS

The drawings constitute a part of this disclosure and include examples, which may be implemented in various forms. It is to be understood that in some instances, various aspects of the disclosure may be shown exaggerated or enlarged to facilitate understanding. The teaching of the disclosure can be readily understood by considering the detailed description in conjunction with the accompanying drawings, which are briefly described below.

Figure 1:
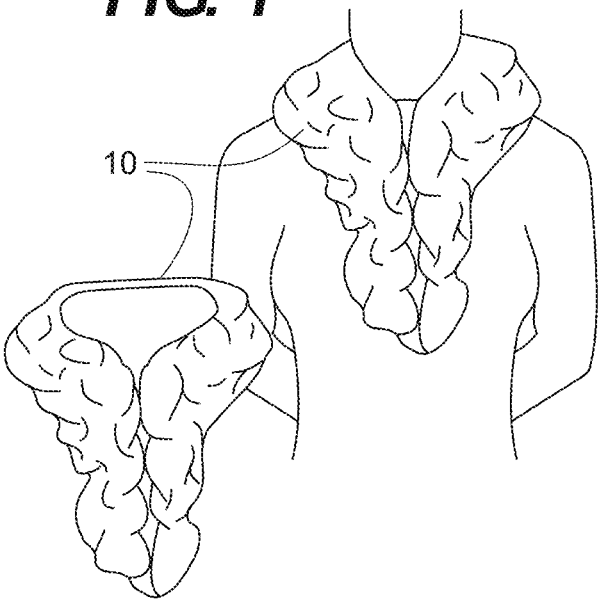
FIG. 1 is a pictorial representation of an embodiment of a scarf of the present disclosure, and shown about the neck of a user.

The various aspects of the present disclosure mentioned above are described in further detail with reference to the aforementioned figures and the following detailed description of exemplary embodiments.

DETAILED DESCRIPTION

Particular illustrative embodiments of the present disclosure are described hereinbelow with reference to the accompanying drawings; however, the disclosed embodiments are merely examples of the disclosure, which may be embodied in various forms. It should be apparent to those skilled in the art that the described embodiments provided herein are illustrative only and not limiting, having been presented by way of example only. All features disclosed in this description may be replaced by alternative features serving the same or similar purpose, unless expressly stated otherwise. Therefore, numerous other embodiments of the modifications thereof are contemplated as falling within the scope of the present disclosure of a scarf as defined herein and equivalents thereto. Well-known functions or constructions and repetitive matter are not described in detail to avoid obscuring the present disclosure in unnecessary or redundant detail. Therefore, specific structural and functional details disclosed herein are not to be interpreted as limiting. In this description, as well as in the drawings, like-referenced numbers represent elements which may perform the same, similar, or equivalent functions.

Throughout the description, where items are described as having, including, or comprising one or more specific components or features, or where methods are described as having, including, or comprising one or more specific steps, it is contemplated that, additionally, there are items of the present disclosure that consist essentially of, or consist of, the one or more recited components or features, and that there are methods according to the present disclosure that consist essentially of, or consist of, the one or more recited processing steps.

The present disclosure is directed to a pre-tied scarf, which may be pre-adjusted for neck size and/or aesthetics prior to donning, having a built-in closure that creates the illusion of a self-tied scarf for a consistent, reproducible look.

Figure 2:
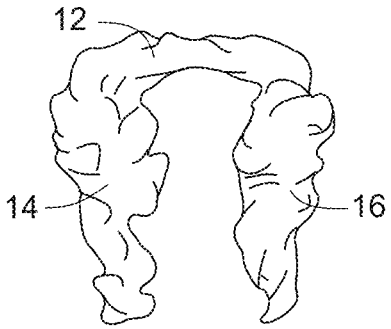
FIG. 2 is a pictorial representation of the embodiment of the scarf of FIG. 1, shown in an open position about the neck of a user, before connecting the ends to form a closure that creates the illusion of a self-tied scarf.
Figure 3:
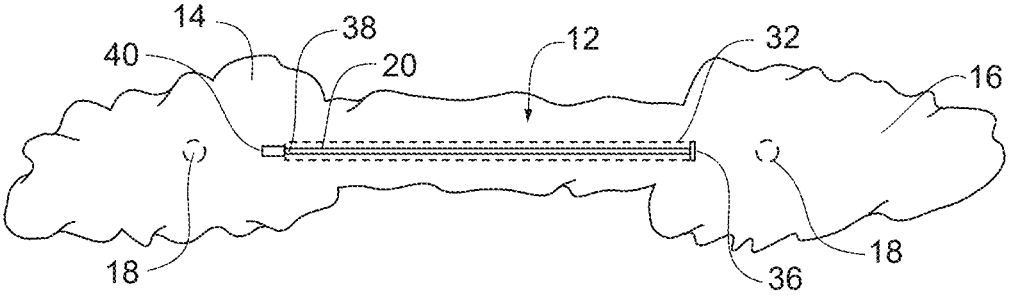
FIG. 3 is a pictorial representation of the scarf of FIG. 1, shown in an open position prior to positioning around, and adjusting for a size of, the neck of a user.

Referring to FIGS. 1-3, an embodiment of a scarf 10 of the present disclosure, includes a neck portion 12 and two end sections, 14, 16, each end section including a portion of a pre-tied scarf with a pair of attachment elements 18 concealed within, each of the attachment elements 18 configured to connect together to form the pre-tied scarf. The neck portion 12, which is positioned between and connectedly extending to the two end sections 14, 16, is adjustable via a size-adjusting element 20, such as a draw-string. The draw-string, or other size-adjusting element, preferably maintains its adjusted position, for desired sizing of the neck opening for example, upon donning and removing the scarf 10; i.e., the means of donning the scarf in its completed design does not rely on the means for adjusting the neck-size, so that the size, and/or aesthetic gathering of the scarf, does not need to be re-adjusted each time the scarf is donned and worn.

In any of the embodiments of the disclosure, the attachment elements 18 may be magnets of opposite polarity aligned to form a closure. In embodiments, the attachment elements 18 may be either loop and hook pads, e.g., of a VELCRO® material, or snaps, or button and buttonhole, or any other known pairs of attachment or closure elements commonly used in clothing, preferably sewn in a manner that conceals them from view upon attachment.

Figure 4:
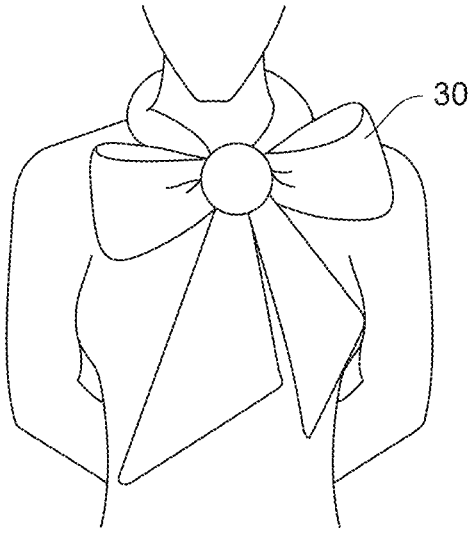
FIG. 4 is a pictorial representation of another embodiment of a scarf of the present disclosure shown about the neck of a user.
Figure 5:
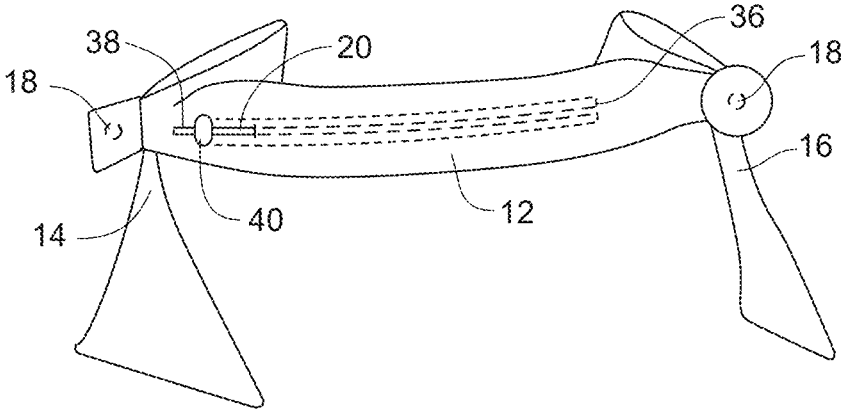
FIG. 5 is a pictorial representation of the embodiment of the scarf of FIG. 4, shown in an open position prior to positioning around, and adjusting for a size of, the neck of a user.

Referring to FIGS. 4 and 5, in another embodiment, an embodiment of a scarf of the present disclosure in the form of a nautical square or a bowtie 30 includes the neck portion 12 and two end sections, 14, 16, first end section 14 and second end section 16, each end section including a portion of a pre-tied scarf, e.g., of the pre-tied nautical square or bowtie 30, with the pair of attachment elements 18 concealed within, each of the attachment elements 18 configured to connect together to form the pre-tied scarf in the form to the nautical square or bowtie 30. The neck portion 12, which is positioned between and connectedly extending to the two end sections 14, 16, is adjustable via a size-adjusting element 20. In the embodiments of FIGS. 1-3 and FIGS. 4-5, the size-adjusting element 20 may be a draw-string, which in embodiments, may be captured in a channel 32, which, in embodiments, may be sewn onto an interior side 42 (see FIG. 8D) of the neck portion 12, and in embodiments, is formed from a liner 34 fixed to the interior side 42. As one of skill in the art will appreciate, the interior side 42 of the scarf is not visible as worn, but only when the scarf is turned inside out. The channel 32 extends from the first end section 14 and across the neck portion 12 to the second end section 16. A first (fixed) end portion 36 of the size-adjusting element 20 in embodiments is sewn in a fixed position to one of the two end sections 14, 16, first end section 14 and second end section 16, on the interior side 42, and, in embodiments, within the channel 32, so that it is not accessible to a user. In the embodiments shown, fixed end portion 36 is fixed to the second end section 16. A second (free) end portion 38 is unattached to the scarf and extends beyond, and out of, the channel 32, which ends on the other one of the two end sections 14, 16, or first end section 14 in the embodiments shown in FIGS. 1-5. The free end portion 38 is accessible to a user to pull on, thereby gathering and shortening the neck portion 12 as needed. The second, or free, end portion 38 may also include a push-button lock 40, which has a push-button that in a depressed position allows the push-button lock 40 to be slid along the drawstring and in a released position locks the push-button lock 40 in a desired position, to maintain a length of the size-adjusting element 20, e.g., drawstring, that is desired to be pulled out of the channel 32.

Figure 6:
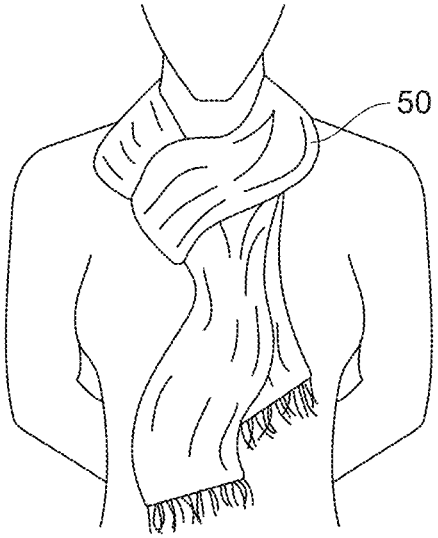
FIG. 6 is a pictorial representation of yet another embodiment of a scarf of the present disclosure shown about the neck of a user.
Figure 7:
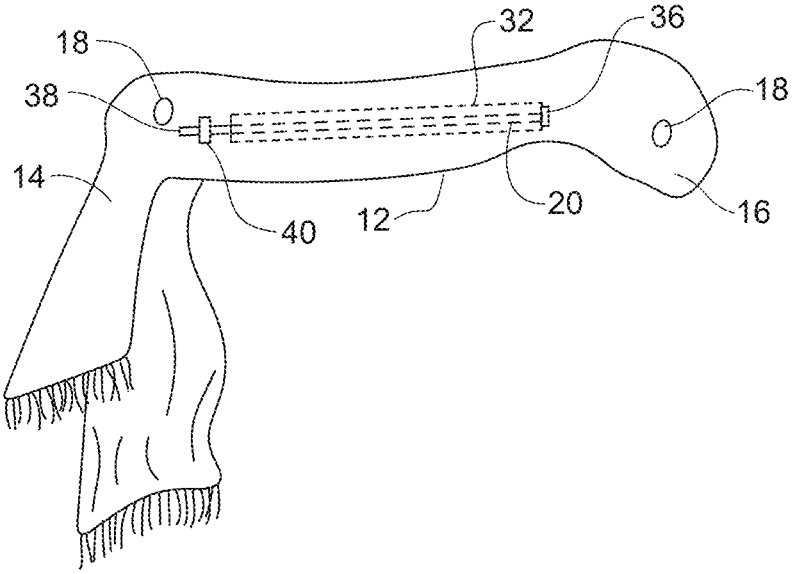
FIG. 7 is a pictorial representation of the scarf of FIG. 6, shown in an open position prior to positioning around, and adjusting for a size of, the neck of a user.

Referring to FIGS. 6 and 7, in another embodiment, an embodiment of a scarf of the present disclosure, in the form of a front-tied scarf 50, includes a neck portion 12 and two end sections, 14, 16, each end section including a portion of a pre-tied scarf e.g., of the pre-tied, front-tied scarf 50, with the pair of attachment elements 18 concealed within, each of the attachment elements 18 configured to connect together to form the pre-tied, front-tied scarf 50. The neck portion 12, which is positioned between and connected to the two end sections 14, 16, is adjustable via the size-adjusting element 20, such as a draw-string, which is preferably captured within the channel 32. The channel 32, as described above, is sewn onto the interior side 42 of the neck portion 12 (see FIG. 8D), and in embodiments, is formed from a liner 34 fixed or sewn to the interior side 42. The first (fixed) end portion 36 of the size-adjusting element 20 in embodiments is sewn in a fixed position on one of the two end sections 14, 16, on the interior side 42, and in embodiments, within the channel 32, so that it is not accessible to a user. A second (free) end portion 38 extends beyond, and out of, the channel 32, which ends on the other one of the two end sections 14, 16, and is accessible to a user to pull on, thereby gathering and shortening the neck portion 12 as needed. The second (free) end portion 38 may also include push-button lock 40 to maintain a length of the size-adjusting element 20, e.g., drawstring, which is desired to be pulled out of the channel 32. The first (fixed) end portion 36 and the second (free) end portion 38 are positioned on opposite end sections 14, 16, i.e., on opposite sides of the neck portion 12, which is centrally located between the end sections 14, 16.

Figure 8A:
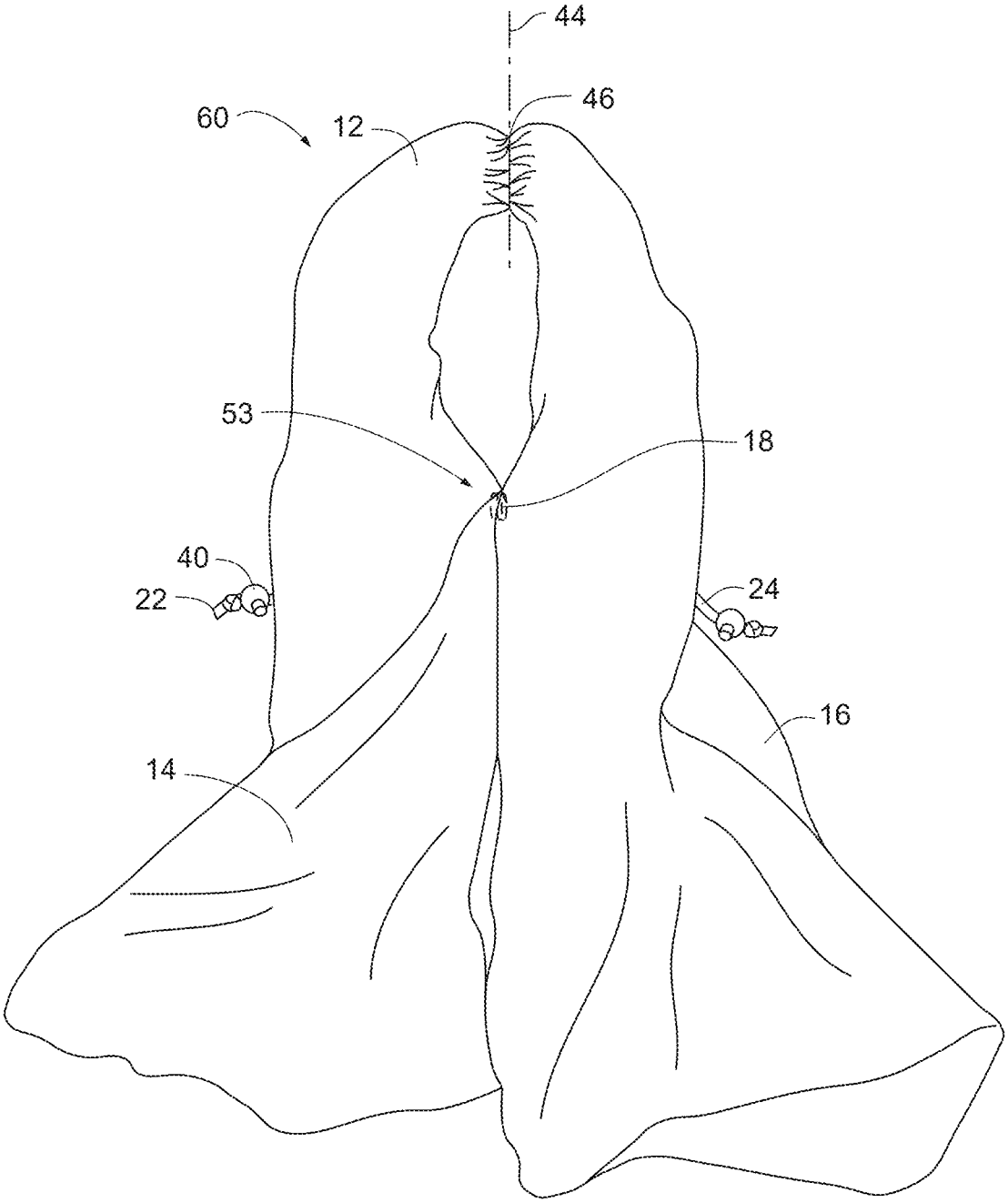
FIG. 8A is a pictorial representation of yet another embodiment of a scarf of the present disclosure shown in a closed position as worn by a wearer, and prior to pulling the drawstrings.
Figure 8B:
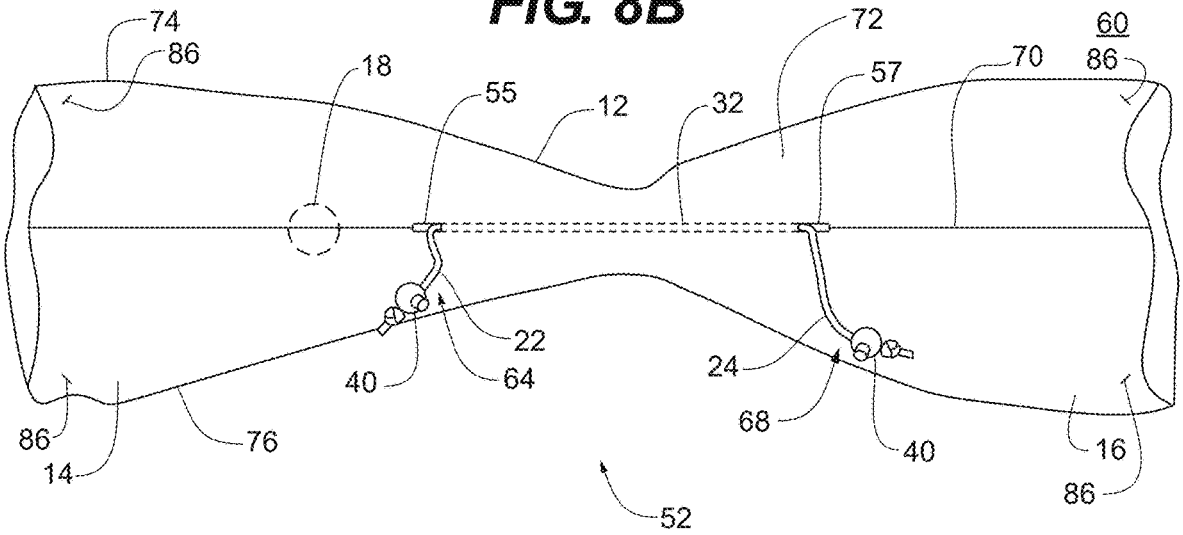
FIG. 8B is a pictorial representation of an inner side, or neck-facing side as worn, of the scarf of FIG. 8A, shown in an open position prior to positioning around, and adjusting for a size of, the neck of a user and before connecting the ends to form a closure that creates the illusion of a self-tied scarf.
Figure 8C:
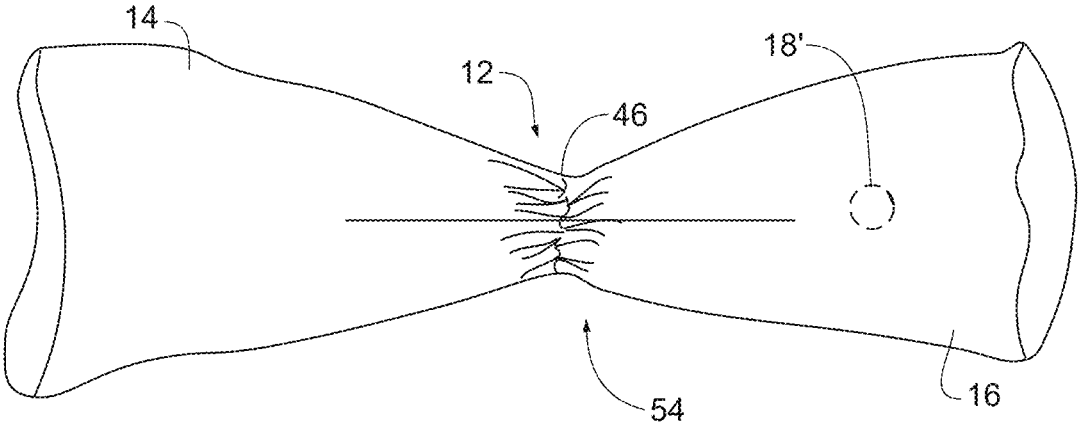
FIG. 8C is a pictorial representation of an outer side, or exposed side as worn, of the scarf of FIG. 8A, shown in the open position.

In another embodiment, referring to FIGS. 8A-8C, an embodiment of a scarf of the present disclosure, in the form of a pre-gathered scarf 60 (shown prior to pulling the draw-strings to gather each of the end sections 14, 16), includes the neck portion 12 and two end sections, 14, 16, each end section including a portion of a gathered portion 72, in use, of the pre-gathered scarf 60, with the pair of attachment elements 18 concealed within, each of the attachment elements 18 configured to connect together to form the pre-gathered scarf 60. As shown in FIG. 8A, each of the two end sections, 14, 16, is configured to extend below the neck portion 12 and along a front of a wearer, in use. The neck portion 12, which is positioned between and extendedly connected to the two end sections 14, 16, is adjustable via a first size-adjusting element 22 and a second size-adjusting element 24, each of which may be a draw-string.

The scarf further includes an inner side 52 (FIG. 8B) and an outer side 54 (FIG. 8C) opposite the inner side 52, wherein the inner side 52 of the neck portion 12 faces a neck of a user as worn, and the inner side 52 of the first end section 14 faces and contacts the inner side 52 of the second end section 16 as worn, as shown, for example, in FIG. 8A. The first size-adjusting element 22 and the second size-adjusting element 24 are accessible to the user from an inner side 52 of the scarf (see FIG. 8B) via first and second slit openings 55, 57, respectively, positioned on each of the two end sections 14, 16, the first slit opening 55 and the second slit opening 57 extending from the inner side 52 through to the interior side 42. As shown in FIG. 8B, the first size-adjusting element 22 and the second size-adjusting element 24 are aligned along a central longitudinal axis 70 of the scarf. Attachment elements 18, 18' are likewise aligned along the central longitudinal axis 70 on either side of the first 22 and second size-adjusting element 24. This arrangement facilitates the inner side 52 of each of the first end section 14 and the second end section 16 to face each other in use, as shown, and as described above. As shown in FIGS. 8A and 8B, with further reference to FIGS. 8D-8F, the first draw-string and the second draw-string are aligned side by side and configured to be pulled in use in opposite directions along and aligned with a central longitudinal axis of the scarf, which, in use (FIG. 8A) is aligned vertically downward along a front of a wearer. As also shown in FIG. 8B, each of the inner side 52 and the outer side 54 of the scarf is defined between a first edge 74 of the scarf, and a second edge 76 opposite the first edge 74, wherein the central longitudinal axis 70 is centered between the first edge 74 and the second edge 76.

In embodiments, one of the attachment elements 18 is positioned on the inner, or neck-facing, side 52 as worn (FIG. 8B) and on one of the two end sections 14, 16, for example, in a first of the two end sections, 14, as shown in FIG. 8B. The other one of the attachment elements 18' is positioned on the outer (exposed) side 54 as worn and on a second of the two end sections, 16, as shown in FIG. 8C. To close the scarf in the front as shown in FIG. 8A to form a closure 53, with the inner side 52 against a neck of the wearer, the attachment element 18' on the exposed side 54 is attached to the attachment element 18 on the inner side 52 to form the closure 53, which is invisible as worn, referring to FIG. 8A, such that the inner side 52 of one end section 14, 16 faces and contacts the outer side 54 of the other end section 16. As described herein, in embodiments, the attachment elements may be complementary pairs of hook and loop elements, snaps, button and buttonhole, or magnets.

Still referring to FIGS. 8A-8C, the pre-gathered scarf 60 may have a gathered seam 46 along a vertical centerline 44 in the neck portion 12. As best seen in FIG. 8B, the scarf may be pre-sewn into a cylinder its ends being left open, as shown. In other embodiments, the ends may be closed via stitching.

Figure 8D:
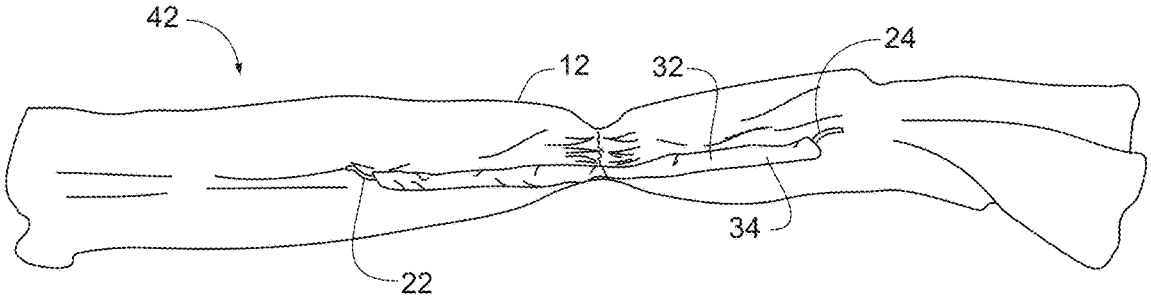
FIG. 8D is a pictorial representation of an interior side of the scarf of FIG. 8A, shown with the lower edge of the neck portion in the open position folded under out of view to optimally view the channel and attachments of the draw-strings.
Figure 8E:
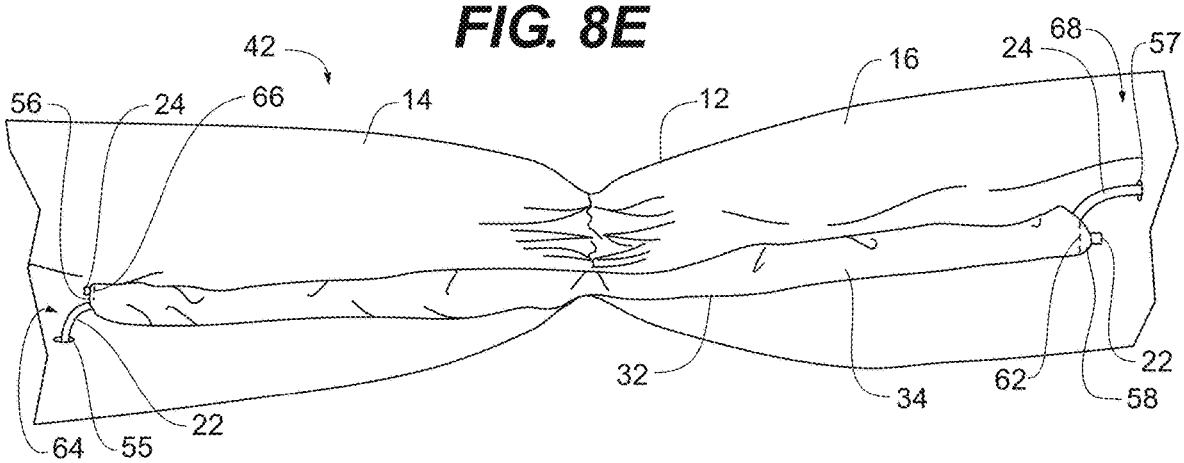
FIG. 8E is a magnified view of the pictorial representation of FIG. 8D.
Figure 8F:
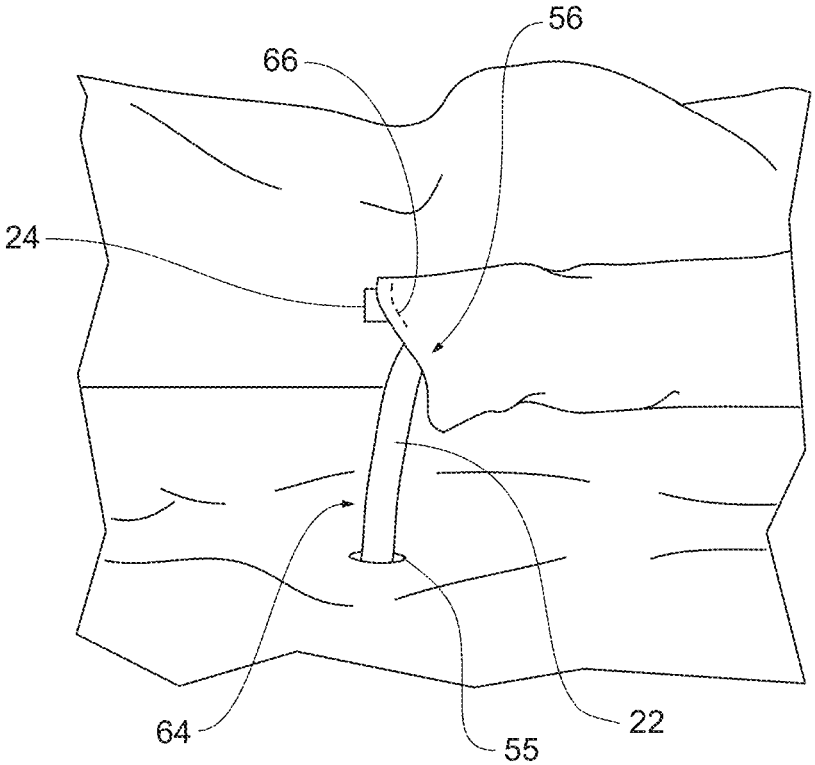
FIG. 8F is a magnified view of an interior side of an end section showing a free end of a first drawstring accessible outside a channel and a fixed end of a second drawstring inside the channel.

Referring also to FIGS. 8D-8F, each of the first size-adjusting element 22 and the second size-adjusting element 24 is preferably captured within the channel 32 sewn onto the interior side 42 of the neck portion 12 (see FIG. 8D) and which, in embodiments, is formed from a liner 34 sewn to the interior side 42. In the embodiment shown, the liner 34 on the interior side 42 of the scarf only covers the portion of the scarf in which the channel 32 is sewn, such that the added liner 34 forms the channel 32. In other embodiments, the scarf 60 may include a liner that substantially covers the interior side 42 of the scarf 60, with the channel 32 sewn into a portion of the liner 34.

The channel 32 extends across the neck portion 12 from first end section 14 to the second end section 16, the channel 32 including a first open end 56 and a second open end 58 positioned on the interior side 42 of the first end section 14 and the second end section 16, respectively. Referring to the magnified views of FIG. 8E and FIG. 8F, together with FIG. 8B, each of the first and second slit openings 55, 57 is proximate each of the first open end 56 and the second open end 58 of the channel 32, respectively. Each of the first size-adjusting element 22 and the second size-adjusting element 24, respectively, is laced through the first and second slit openings 55, 57, respectively, to the inner side 52, for access by a user. Each size-adjusting element 22, 24 is drawn in opposite directions through the channel 32, and through slit openings 55, 57, respectively, as further described below, to gather a portion of the scarf 60 over which the channel 32 extends, to form a gathered portion 72 (referring to FIG. 8B) of the scarf 60, as much as desired by the user. It should be clear from the pre-gathered scarf shown in FIG. 8A prior to pulling the size-adjusting elements 22, 24, and from the placement of the channel 32 within which the size-adjusting elements 22, 24 are captured, that when a user pulls the first and second size-adjusting elements 22, 24 along the closure (via the attachment elements) between the first 14 and second end sections 16, the gathered portion 72 creates a gathered aesthetic (see FIG. 9B) along the first 14 and second end sections 16 extending down a front of a wearer, as well as around a neck of a wearer, as shown for a similar embodiment 80 to the scarf 60 as described herein below.

In embodiments, the channel 32 extends over a central portion of the scarf that includes the neck portion 12, and over at least half a total length of the scarf.

In particular, a first (fixed) end portion 62 of the first size-adjusting element 22 in embodiments is sewn in a fixed position to one of the first and second end sections 14, 16, e.g., second end section 16, preferably on the interior side 42 and proximate the second open end 58 of the channel 32, and in embodiments, within the channel 32. The fixed end portion 62 is preferably not accessible to a user. A second (free) end portion 64 of the first size-adjusting element 22 extends beyond, and out of, the channel 32 through the first open end 56, and then is laced into and through the first slit opening 55 to the inner side 52 of the scarf where it is exposed and accessible by a user. Likewise, a first (fixed) end portion 66 of the second size-adjusting element 24 in embodiments is sewn in a fixed position to one of the first and second end sections 14, 16, e.g., first end section 14, preferably on the interior side 42 and proximate the first open end 56 of the channel 32, and in embodiments, within the channel 32. The fixed end portion 66 is preferably not accessible to a user. A second (free) end portion 68 of the second size-adjusting element 24 extends beyond, and out of, the channel 32 through the second open end 58, and then into and through the opening 57 to the inner side 52 of the scarf where it is exposed and accessible by a user (see FIG. 8B).

Each size-adjusting element 22, 24 is drawn via its free ends 64, 68, respectively, which are accessible to the user from the inner side 52 (FIG. 8B), in opposite directions through the channel 32, and through first and second slit openings 55, 57, respectively. The fixed ends 62, 68, of the size-adjusting elements 22, 24, respectively, are anchored to opposite end sections 14, 16 of the scarf 60. Accordingly, when a user pulls simultaneously on free ends 64, 68, in opposite directions, the portion of the scarf 60 over which the channel 32 extends may be gathered as much as desired by the user both for sizing around the neck, and to achieve a desired aesthetic.

Figure 9A:
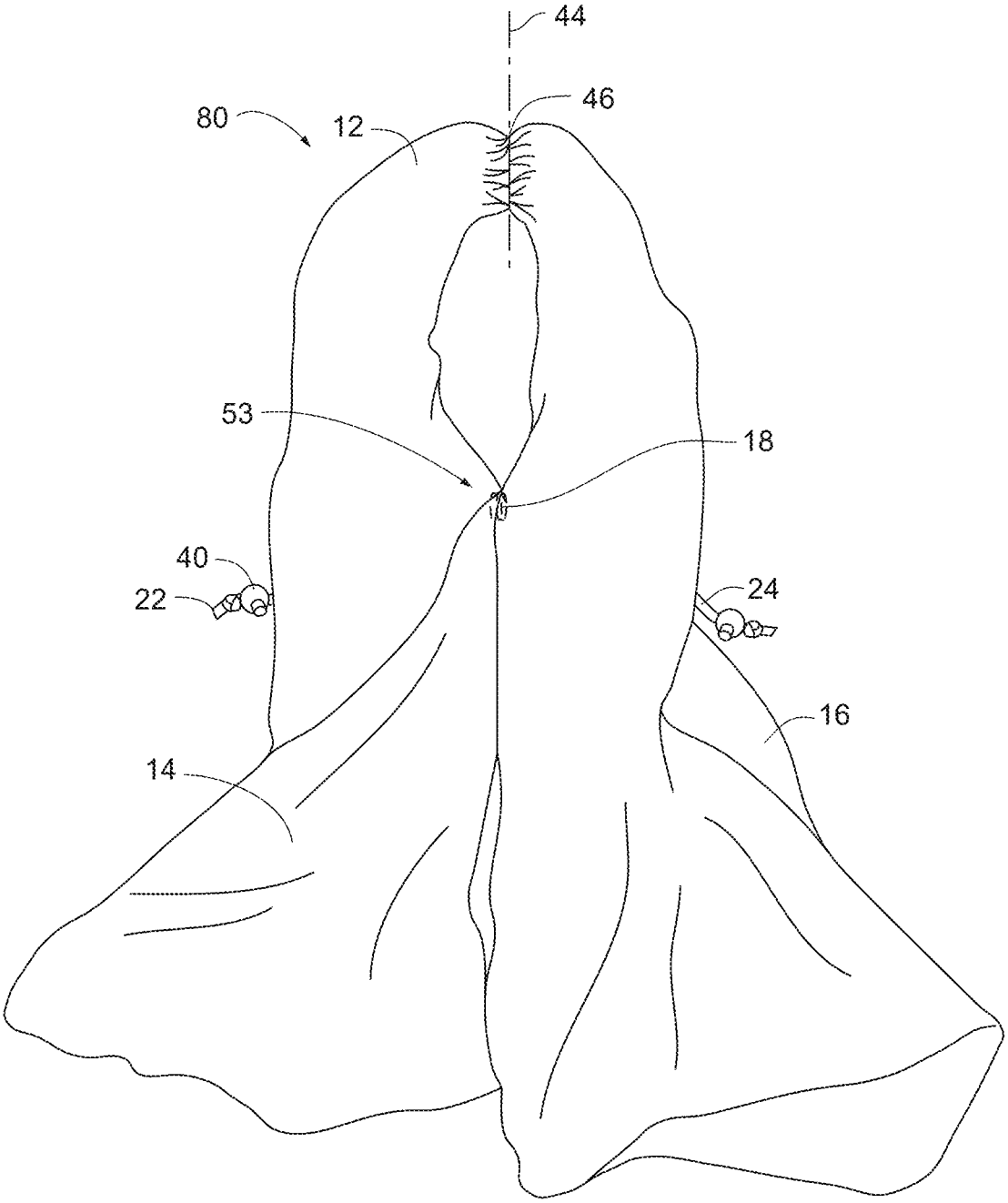
FIG. 9A is a pictorial representation of another embodiment of the scarf, similar to that shown in FIG. 8A, shown in a closed position as worn by a wearer, and prior to pulling the drawstrings.
Figure 9B:
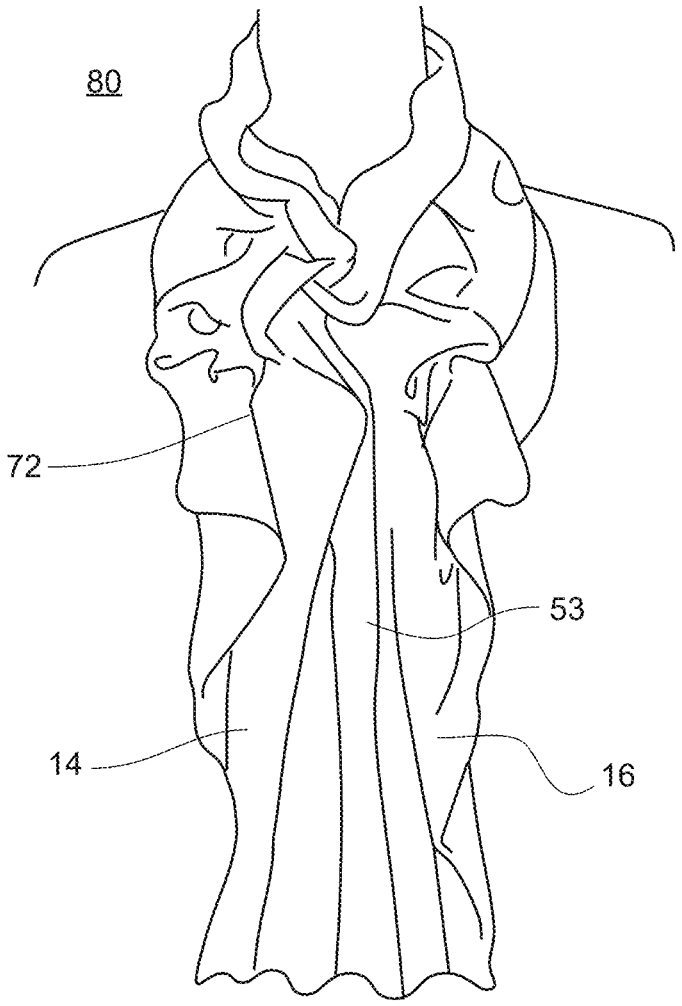
FIG. 9B is a pictorial representation of the scarf of FIG. 9A and of the scarf of 8A, as worn by a user after pulling the drawstrings.
Figure 9C:
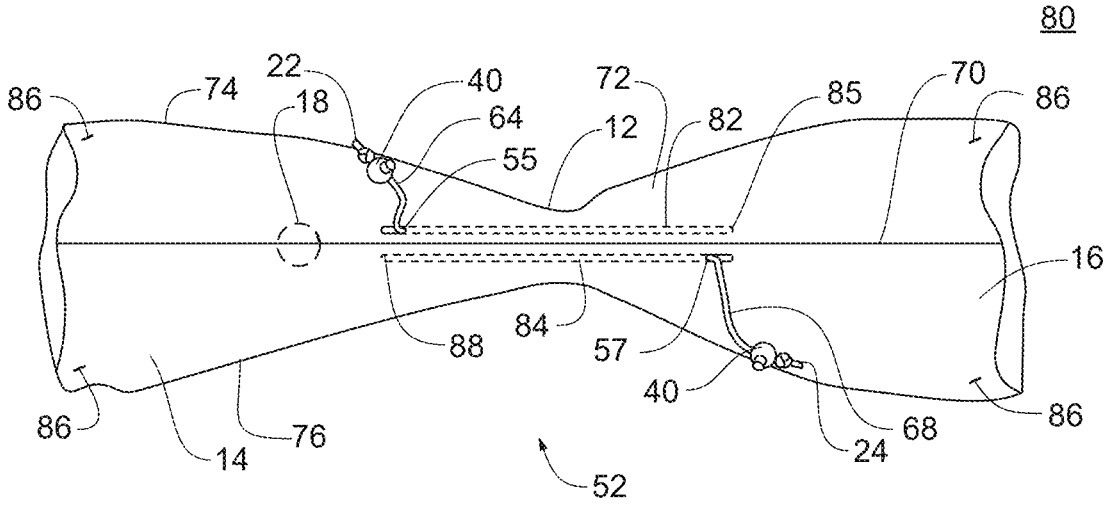
FIG. 9C is a pictorial representation of an inner side, or neck-facing side as worn, of the scarf of FIG. 9A, shown in an open position prior to positioning around, and adjusting for a size of, the neck of a user and before connecting the ends to form a closure that creates the illusion of a self-tied scarf.

Referring again to FIG. 8B, and also to FIG. 9C, in embodiments, the inner side 52 and the outer side 54 of the scarf may be tacked together to maintain a rectangular or bowtie shape in the open position as shown, for example, in FIGS. 8B and 9C, at least at each of its four corners 86. As also described in reference to FIG. 8B above, even with the tacked corners, the scarf 60, as well as the scarf 80 represented in FIG. 9A, may be pre-sewn into a cylinder with its ends being left open. In other embodiments, the ends may be closed via stitching. In additional embodiments, the first (upper) edge 74 and the second (lower) edge 76 may also be sewn, or optionally tacked at multiple points, to hold a more well-defined outer shape.

The embodiment of the scarf 80 shown in FIGS. 9A-9E, forms the same aesthetic when in use, with the draw-stings pulled as shown in FIG. 9B, as the scarf 60 of FIGS. 8A-8E. The scarf 80 also has the same components as indicated by the reference numerals, with the exception that channel 32 of scarf 60 is replaced by two channels aligned side-by-side: a first channel 82 in which the first draw-string 22 is captured, and a second channel 84 in which the second draw-strings 24 is captured, so that the draw-strings 22, 24 are aligned side-by-side but separately confined to its respective channel 82, 84. The scarf 80, referring to FIG. 9A, includes the neck portion 12 and two end sections, 14, 16, each end section including a portion of a gathered portion 72, in use, with the pair of attachment elements 18 concealed within, each of the attachment elements 18 configured to connect together to form the scarf 80. The neck portion 12, which is positioned between and extendedly connected to the two end sections 14, 16, is adjustable via the first size-adjusting element 22, e.g., first draw-string 22, and a second size-adjusting element 24, e.g., second draw-string 24.

The scarf further includes the inner side 52 (FIG. 9C) and an outer side 54 (FIG. 9D) opposite the inner side 52, wherein the inner side 52 of the neck portion 12 faces a neck of a user as worn, and the inner side 52 of the first end section 14 faces and contacts the inner side 52 of the second end section 16 as worn, as shown, for example, in FIG. 9A. The first size-adjusting element 22 and the second size-adjusting element 24 are accessible to the user from an inner side 52 of the scarf (see FIG. 9C) via first and second slit openings 55, 57, respectively, positioned on each of the two end sections 14, 16, the first slit opening 55 and the second slit opening 57 extending from the inner side 52 through to the interior side 42. As shown in FIG. 9C, the first size-adjusting element 22 and the second size-adjusting element 24 are aligned side-by-side within the first channel 82 and the second channel 84, respectively, along the central longitudinal axis 70 of the scarf 80. Attachment elements 18, 18' are likewise aligned along the central longitudinal axis 70 on either side of the first 22 and second size-adjusting element 24. This arrangement facilitates the inner side 52 of each of the first end section 14 and the second end section 16 to face each other in use, as shown, and as described above. As shown in FIGS. 9A and 9C, with further reference to FIG. 9E, each of the first draw-string 22 and the second draw-string 24 is captured within each of the first channel 82 and the second channel 84, which are aligned side by side. The first 22 and second draw-strings 24 are configured to be pulled in use in opposite directions along and aligned with a central longitudinal axis of the scarf, which, in use (FIG. 9A) is aligned vertically downward along a front of a wearer. As also shown in FIG. 9C, each of the inner side 52 and the outer side 54 of the scarf is defined between the first edge 74 of the scarf, and the second edge 76 opposite the first edge 74, wherein the central longitudinal axis 70 is centered between the first edge 74 and the second edge 76.

Figure 9D:
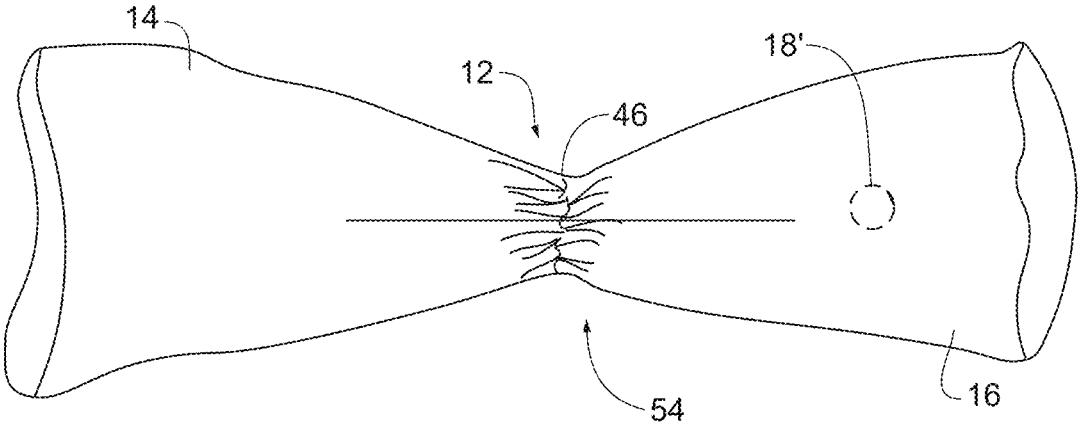
FIG. 9D is a pictorial representation of an outer side, or exposed side as worn, of the scarf of FIG. 9A, shown in the open position.

In embodiments, one of the attachment elements 18 is positioned on the inner, or neck-facing, side 52 as worn (FIG. 9C) and on one of the two end sections 14, 16, for example, in a first of the two end sections, 14, as shown in FIG. 9C. The other one of the attachment elements 18' is positioned on the outer (exposed) side 54 as worn and on a second of the two end sections, 16, as shown in FIG. 9D. To close the scarf in the front as shown in FIG. 9A to form a closure 53, with the inner side 52 against a neck of the wearer, the attachment element 18' on the exposed side 54 is attached to the attachment element 18 on the inner side 52 to form the closure 53, which is invisible as worn, referring to FIG. 9A, such that the inner side 52 of one end section 14, 16 faces and contacts the outer side 54 of the other end section 16. As described herein, in embodiments, the attachment elements may be complementary pairs of hook and loop elements, snaps, button and buttonhole, or magnets.

Figure 9E:
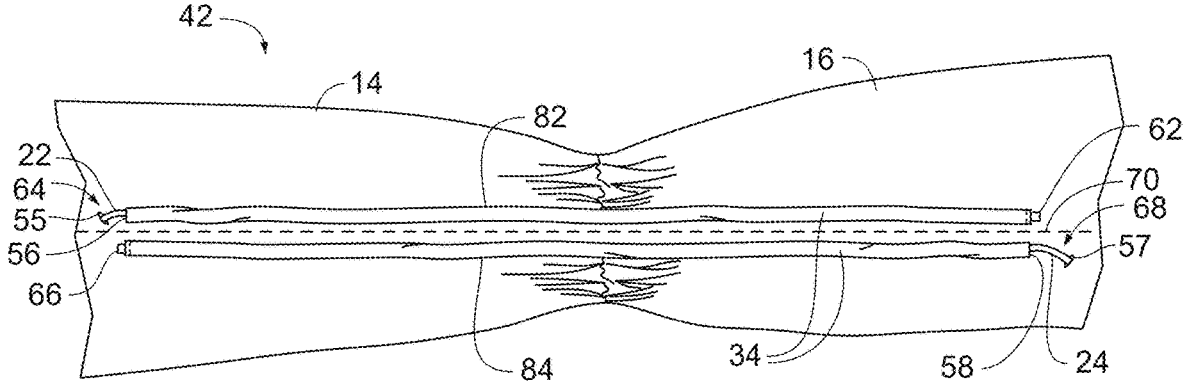
FIG. 9E is a magnified view of a central portion of an interior side of the scarf of FIG. 9A, showing the channels in which the draw-strings are confined.

Referring also to FIG. 9E, each of the first size-adjusting element 22 and the second size-adjusting element 24 is captured, in embodiments, within the first channel 82 and the second channel 84, respectively. Each of the first channel 82 and the second channel 84, in embodiments, may be sewn onto the interior side 42 of the neck portion 12 and, in embodiments, is formed from the liner 34 sewn to the interior side 42. In the embodiments shown, the liner 34 on the interior side 42 of the scarf only covers the portion of the scarf in which each of the first channel 82 and the second channel 84 is sewn, such that the added liner 34 forms the channels 82, 84. Although the first channel 82 and the second channel 84 appear to be formed in two distinct channels stitched into the interior side 42, it should be clear that one piece of material, such as liner 34, may be overlaid on the interior side 42 with the two channels 82, 84, formed by stitching a seam in the center of the liner 34, e.g., along the central longitudinal axis 70, to separate the attached liner 34 and thereby form the side-by-side channels 82, 84. In other embodiments, the scarf 80 may include a liner 34 that substantially covers the interior side 42 of the scarf 80, with the channels 82, 84 sewn into the liner 34 along the longitudinal axis 70 using stitching to form the edges of the channels 82, 84. In embodiments, the draw-strings 22, 24 may be captured between the liner 34, and the underlying material forming the scarf 80 and within the longitudinal confines of each channel 82, 84.

Each of the first 82 and second channel 84 extends across the neck portion 12 from the first end section 14 to the second end section 16. The first channel 82 includes a first open end 56 and the second channel 84 includes a second open end 58 positioned on the interior side 42 of the first end section 14 and the second end section 16, respectively. Referring to the magnified views of FIG. 9E, together with FIG. 9C, each of the first and second slit openings 55, 57 is proximate each of the first open end 56 of the first channel 82 and the second open end 58 of the second channel 84, respectively. Each of the first draw-string 22 and the second draw-string 24, respectively, is laced through the first and second slit openings 55, 57, respectively, to the inner side 52, for access by a user. Each draw-string 22, 24 is drawn in opposite directions through the respective channels 82, 84, and out through slit openings 55, 57, respectively, as further described below, to gather a portion of the scarf 80 over which the channels 82, 84 extend to form a gathered portion 72 (referring to FIG. 9C) of the scarf 80, as much as desired by the user. Referring to FIG. 9B, when a user pulls the first and second draw-strings 22, 24 along the closure (via the attachment elements) between the first 14 and second end sections 16 of the pre-gathered scarf shown in FIG. 9A, the gathered portion 72 creates a gathered aesthetic along the first 14 and second end sections 16 extending down a front of a wearer, as well as around a neck of a wearer.

In embodiments, each of the channels 82, 84 extends over a central portion of the scarf that includes the neck portion 12, and over at least half a total length of the scarf.

In particular, a first (fixed) end portion 62 of the first draw-string 22 in embodiments is sewn in a fixed position to one of the first and second end sections 14, 16, e.g., second end section 16, preferably on the interior side 42 and proximate, or at, an end 85 of the first channel 82 that is opposite the first open end 56, and in embodiments, within the channel 82. In embodiments, the end 85 is closed, with the fixed end portion 62 of the first draw-string 22 being fixed together with the end 85 by stitching, for example. The fixed end portion 62 is preferably not accessible to a user. A second (free) end portion 64 of the first size-adjusting element 22 extends through, and exits out of, the first channel 82 through the first open end 56, and then is laced into and through the first slit opening 55 to the inner side 52 (see FIG. 9C) of the scarf where it is exposed and accessible by a user. Likewise, a first (fixed) end portion 66 of the second size-adjusting element 24 in embodiments is sewn in a fixed position to one of the first and second end sections 14, 16, e.g., first end section 14, preferably on the interior side 42 and proximate, or at, an end 88 of the second channel 84 that is opposite the second open end 58, and in embodiments, within the channel 84. The fixed end portion 66 is preferably not accessible to a user. A second (free) end portion 68 of the second size-adjusting element 24 extends through, and exits out of, the second channel 84 through the second open end 58, and then into and through the opening 57 to the inner side 52 of the scarf where it is exposed and accessible by a user (see FIG. 9C).

Each size-adjusting element 22, 24 is drawn out of first channel 82 and second channel 84, respectively, via its free end 64, 68, each of which is accessible to the user from the inner side 52 (FIG. 9C), in opposite directions through the first channel 82 and second channel 84, and out through first and second slit openings 55, 57, respectively. The fixed ends 62, 68, of the size-adjusting elements 22, 24, respectively, are anchored to opposite end sections 14, 16 of the scarf 80 as described herein. Accordingly, when a user pulls simultaneously on free ends 64, 68, in opposite directions, the portion of the scarf 80 over which the first 82 and second channel 84 extend, may be gathered as much as desired by the user both for sizing around the neck, and to achieve a desired aesthetic, as shown in FIG. 9B.

It is understood that for any of the embodiments FIGS. 1-7 shown with a single draw-string, wherein the channel 32 is sewn on the interior side 42 of the scarf, the first slit opening 55 shown in FIGS. 8A-8F proximate the first open end 56 of the channel 32 may be provided, so that the size-adjusting element 20 may be laced through the first slit opening 55, which extends to the inner side 52 of the scarf, for access by a user from the inner side 52 as described with reference to FIGS. 8A-8F and 9A-9E.

Many other designs are contemplated to be within the scope of the present disclosure, the present disclosure able to be adjusted for any number of known styles of tied scarves. In addition, by isolating the adjustability of the neck portion from the closure, both the size and the style, i.e., the tied portion are preconfigured prior to tying, so that the scarf is configured to be easily and quickly donned by the user.

The scarf of the present disclosure may be formed from any number of materials. In embodiments, the scarf is formed of a knitted fabric.

In embodiments, the channel sewn onto the interior side of the scarf is formed of a satin material.

In embodiments, the attachment elements are pairs of magnetic snap connectors.

In further embodiments, additional magnetic snap connectors may be concealed within the scarf. For example, an additional magnetic element may be included proximate the neck position, to allow one of the end sections 14, 16 to be draped across the neck and closed along the shoulder or neck line.

While particular embodiments of the present disclosure have been particularly shown and described with reference to specific embodiments, it should be apparent to those skilled in the art that the foregoing is illustrative only and not limiting, having been presented by way of example only. It is to be understood that the disclosed embodiments are merely examples of the disclosure, which may be embodied in various forms and detail without departing from the spirit and scope of the disclosure. Therefore, specific structural and functional details disclosed herein are not to be interpreted as limiting. Numerous other embodiments may fall within the scope of the accompanying claims and equivalents thereto.

The invention claimed is:

1. A scarf comprising:

a neck portion configured for positioning in use behind a neck of a wearer;

a first end section and a second end section, the neck portion centrally positioned and connectedly extending between the first end section and the second end section, wherein each of the first end section and the second end section is configured to extend vertically downward below the neck portion and vertically opposite each other downward along a front of a wearer in use;

a first edge, and a second edge running horizontally opposite to and below the first edge of the scarf in an open position ready for donning, and a central longitudinal axis defined centered horizontally between the first edge and the second edge of the scarf in the open position, the neck portion including the first edge and the second edge configured for horizontally positioning around a wearer's neck in use, and the first edge, the second edge, and the central longitudinal axis of the first end section and the second end section of the scarf configured to align vertically downward in use along a front of a wearer; and a first channel and a second channel sewn into the scarf side-by-side along the central longitudinal axis, wherein a first draw-string and a second-drawstring are captured within the first channel and the second channel respectively, the first draw-string and the second draw-string are confined to the central longitudinal axis of the scarf via the first channel and the second channel to gather the scarf along the central longitudinal axis, each of the first draw-string and the second draw-string extending between the first end section and the second end section and across the neck portion therebetween via the first channel and the second channel respectively, and downward along a front of a wearer in use, wherein the first draw-string includes a fixed end portion and a free end portion between the first end section and the second end section, and the second draw-string includes a fixed end portion and a free end portion between the first end section and the second end section, each of the first draw-string and the second draw-string is configured to be pulled in opposite directions along and confined to the central longitudinal axis of the scarf via the first channel and the second channel respectively to form a gathered portion along a closure of the scarf below the neck portion and in a front of a wearer in use;

wherein each of the first end section and the second end section has an attachment element concealed within, and wherein the attachment element of each of the first end section and the second end section is aligned along the central longitudinal axis and configured to form the closure between the first end section and the second end section and the gathered portion that extends downward along the closure in a front of a wearer in use; and wherein the scarf including the gathered portion along the closure is configured to appear, as worn, as a self-tied, gathered scarf around a neck and a front of a wearer in use.

2. The scarf of claim 1, wherein an inner side defined between the first edge and the second edge, and an outer side of the scarf opposite the inner side, wherein the inner side of the neck portion faces a neck of a wearer as worn, and the inner side of the first end section faces, contacts, and is connected to, one of the inner side and the outer side of the second end section at the central longitudinal axis via the attachment elements in a closed position of the scarf, and wherein the inner side of the first end section and the one of the inner side and the outer side of the second end section are connected via the attachment element in each of the first end section and the second end section to form the closure along the central longitudinal axis.

3. The scarf of claim 1, further including the first channel having a first open end located in the first end section and an end opposite the first open end located in the second end section, and the second channel having a second open end located in the second end section and an end opposite the second open end located in the first end section, wherein the first draw-string and the second draw-string are configured to be pulled downward within the first channel and the second channel, respectively, in opposite directions in use by a wearer to gather and shorten the gathered portion of the scarf in use, wherein the gathered portion defined by the first channel and the second channel extends from the first end section across the neck portion and to the second end section and downward along the closure and along a front of a wearer in use, wherein the fixed end portion of the first draw-string is fixed to the second end section at the end of the first channel, the first draw-string extending through the first channel and exiting the first channel through the first open end, and wherein the fixed end portion of the second draw-string is fixed to the first end section at the end of the second channel, the second draw-string extending through the second channel and exiting the second channel through the second open end, the free end portion of each of the first draw-string and the second draw-string being accessible to a wearer and configured to be pulled by a wearer in opposite directions to gather and shorten the portion of the scarf over which the first channel and the second channel extend, wherein each of the attachment element in the first end section and the attachment element in the second end section is positioned outside the first open end and the second open end of the first channel and the second channel, respectively.

4. The scarf of claim 1, wherein the free end portion of each of the first draw-string and the second draw-string includes a push-button lock, the push-button lock being unlocked in a depressed position and locked in a released position, the push-button lock being slidable along the free end portion in the depressed position, and locked to maintain the size of the neck portion in the released position.

5. The scarf of claim 2, the scarf including an interior side that is not visible as worn, wherein each of the first channel and the second channel is sewn onto the interior side.

6. The scarf of claim 5, the scarf further including a first slit opening in the first end section positioned proximate the first open end of the first channel and a second slit opening in the second end section positioned proximate the second open end of the second channel, wherein each of the first slit opening and the second slit opening extends from the interior side of the scarf to the inner side of the scarf, and wherein the free end portion of each of the first draw-string and the second draw-string that exits each of the first open end and the second open end of the first channel and the second channel, respectively, is laced through each of the first slit opening and the second slit opening, respectively, to the inner side of the scarf and configured for access by a wearer as worn.

7. The scarf of claim 2, wherein the attachment element concealed in the first end section is positioned on the inner side of the scarf and the attachment element concealed in the second end section is positioned on the outer side and aligned to form the closure of the scarf as worn, the inner side of the first end section facing and contacting the outer side of the second end section via the attachment elements to form the gathered portion along a front of a wearer in use.

8. The scarf of claim 1, wherein the neck portion includes a gathered seam along a vertical centerline defined vertically downward from the first edge to the second edge in the neck portion of the scarf in the open position.

9. The scarf of claim 1, wherein each of the attachment elements is a magnet, each of the magnets being of opposite polarity and configured and aligned to snap together to form the closure.

10. The scarf of claim 2, wherein the scarf has a rectangular or bowtie shape in the open position.

11. The scarf of claim 10, wherein the inner side is tacked to the outer side at each corner of the scarf in the open position.

* * * * *